US007594395B2

(12) United States Patent
Oka et al.

(10) Patent No.: US 7,594,395 B2
(45) Date of Patent: Sep. 29, 2009

(54) HYDRAULIC CONTROL DEVICE FOR WORKING MACHINE

(75) Inventors: Hidekazu Oka, Hiroshima (JP); Yutaka Toji, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 223 days.

(21) Appl. No.: 11/612,909

(22) Filed: Dec. 19, 2006

(65) Prior Publication Data

US 2007/0169474 A1 Jul. 26, 2007

(30) Foreign Application Priority Data

Jan. 20, 2006 (JP) ..... 2006-012206

(51) Int. Cl.
*F15B 11/17* (2006.01)
*E02F 9/22* (2006.01)

(52) U.S. Cl. ..... 60/421; 60/486

(58) Field of Classification Search ..... 60/421, 60/422, 486
See application file for complete search history.

(56) References Cited

U.S. PATENT DOCUMENTS 5,101,627 A * 4/1992 Fujii et al. ..... 60/486
6,148,548 A 11/2000 Tohji
6,378,303 B1 * 4/2002 Higuchi et al. ..... 60/468
6,430,922 B2 * 8/2002 Tohji ..... 60/421
6,688,102 B2 * 2/2004 Oka ..... 60/422
6,708,490 B2 * 3/2004 Toji et al. ..... 60/421
7,178,333 B2 * 2/2007 Oka ..... 60/421
2004/0244232 A1 12/2004 Toji
2005/0204734 A1 9/2005 Oka
2005/0204736 A1 9/2005 Toji et al.
2007/0089408 A1 4/2007 Toji
2007/0169474 A1 7/2007 Oka et al.
2008/0016861 A1 1/2008 Toji

FOREIGN PATENT DOCUMENTS

JP 11-303809 11/1999
JP 2000-170212 6/2000
JP 2003-56505 2/2003
JP 2003-090302 3/2003
JP 2003090302 A * 3/2003

* cited by examiner

*Primary Examiner*—Thomas E Lazo
(74) *Attorney, Agent, or Firm*—Oblon, Spivak, McClelland, Maier & Neustadt, L.L.P.

(57) ABSTRACT

A hydraulic control device for a working machine includes control valves; hydraulic actuators controlled by corresponding control valves and divided into groups; unified bleed-off valves disposed on discharge lines of first and second hydraulic pumps; central bypass paths provided in the control valves, the central bypass paths of each group being connected in tandem so as to form a central bypass line; and bypass-cutting valves disposed on the central bypass lines, the bypass-cutting valves being automatically switched so as to open the central bypass lines when the unified bleed-off valves are not operated.

6 Claims, 5 Drawing Sheets

HYDRAULIC CONTROL DEVICE FOR WORKING MACHINE

BACKGROUND OF THE INVENTION

1. Field of the Invention

The present invention relates to hydraulic control devices for working machines such as hydraulic excavators.

2. Description of the Related Art

In hydraulic excavators, for example, some (surplus) oil discharged from pumps is returned (unloaded) to tanks (bleed-off control).

In general, this control is performed by changing the opening areas of bleed-off paths formed in control valves for corresponding actuators in response to inputs through operating means.

However, the length of the control valves is increased due to the length of the bleed-off paths in a spool shaft direction, resulting in an increase in cost and difficulty in assembling the control valves into machines.

To date, in some technologies, a common unified bleed-off valve has been provided for a plurality of control valves (hydraulic actuators) instead of the above-described bleed-off paths for the corresponding control valves (unified bleed-off system).

Moreover, a method for electronically controlling a hydraulic pilot valve serving as the unified bleed-off valve using a downstream pressure of a proportional solenoid valve that is controlled by a controller is often employed in such unified bleed-off systems (for example, Japanese Unexamined Patent Application Publication No. 11-303809).

This unified bleed-off control method has high control flexibility compared with a hydraulic control method in which a pilot pressure according to the operation is directly input to the unified bleed-off valve.

However, in this method, operation of the actuators may be hindered when the unified bleed-off valve fails.

For example, if the unified bleed-off valve that blocks oil when it is in a neutral state fails while all the control valves are in a neutral state (all the actuators are not operated), a relief valve is operated and generates heat.

In contrast, if the unified bleed-off valve that unloads oil when it is in a neutral state fails, the unloading state of the unified bleed-off valve is maintained. Thus, the actuators become inoperable, and the machine stops moving.

In particular, in the above-described electronically controlled system, these problems are serious since the proportional solenoid valve often breaks down or the unified bleed-off valve often fails due to abnormalities such as breaks in wires that transmit control signals from the controller to the proportional solenoid valve in the control system.

On the other hand, in hydraulic excavators, hydraulic actuators are divided into two groups, and the two groups are driven by separate pumps such that the total flow rate of the pumps is efficiently divided and distributed to the actuators in view of flow rates required for the hydraulic actuators, combined control, and the like.

In this case, left and right driving motors (hydraulic motors) that drive crawler-mounted traveling sections belong to the separate groups, and are basically driven by the separate pumps.

For example, in the case of the structure where oil discharged from two hydraulic pumps is distributed to two groups, it is preferable that the oil discharged from both pumps be merged and distributed to both groups for ensuring a required flow rate when control valves for both the driving motor and an attachment in the first group are operated at the same time (hereinafter referred to as a simultaneous operation).

Therefore, a switching valve for switching flow channels is disposed at the discharge side of the pumps such that the oil discharged from both pumps is merged and distributed to both groups during the simultaneous operation.

Accordingly, when the unified bleed-off control method is employed, the problems that occur during failure of the unified bleed-off valve must be solved with consideration of the above-described circuit structure.

SUMMARY OF THE INVENTION

An object of the present invention is to provide a hydraulic control device for a working machine capable of ensuring the operation of hydraulic actuators and at the same time preventing heat caused by a relieving operation even when a unified bleed-off valve is not operated, the hydraulic actuators being divided into groups and driven by oil discharged from common pumps as required.

First, the control device for controlling the oil pressure of the working machine includes the following basic structure.

That is, the control device for controlling the oil pressure of the working machine includes control valves switched by operating means; hydraulic actuators separately controlled by corresponding control valves, the hydraulic actuators being divided into groups, oil discharged from common hydraulic pumps being supplied to the groups; unified bleed-off valves separately performing unified bleed-off operation on the groups on the basis of signals output from controlling means according to inputs from the operating means; central bypass paths provided in the control valves, the central bypass paths of each group being connected in tandem so as to form a central bypass line for unloading operation; and bypass-cutting valves disposed adjacent to the most downstream part of the central bypass lines for opening or closing the central bypass lines. The bypass-cutting valves are automatically switched on the basis of the signals output from controlling means, and open the central bypass lines when the unified bleed-off valves are not operated.

With this structure, the oil discharged from the pumps is unloaded via the central bypass lines even when the unified bleed-off valves are not operated. Thus, even when the unified bleed-off valves are configured to block oil when it is in a neutral state, heat caused by a relieving operation can be prevented.

Moreover, when the control valves are operated, the central bypass paths are closed such that the unloading operation via the central bypass lines is stopped, and the oil is supplied to the actuators. Thus, the operation of the actuators can be ensured.

For example, it is assumed that hydraulic actuators are divided into first and second groups, and oil discharged from common pumps is distributed to both groups (a state where a switching valve for switching flow channels is switched to a simultaneous-operation position as described in a second aspect of the present invention). According to a known technology, the oil discharged from the pumps is unloaded via the central bypass line of the first group when all the control valves in the first group are in a neutral state. Therefore, the actuators in the second group cannot be operated.

In contrast, according to the present invention including the bypass-cutting valves disposed adjacent to the most downstream part of the central bypass lines, the central bypass line in the first group is closed using the bypass-cutting valve, and thus the oil supply to the second group is ensured.

That is, on the premise of a circuit structure in which the actuators are divided into multiple groups and the oil discharged from the common pumps is supplied to the groups, the unified bleed-off control method using unified bleed-off valves can be employed while heat caused by a relieving operation during failure of the unified bleed-off valves can be prevented and the operation of the actuators can be ensured both during failure and during normal operation of the unified bleed-off valves.

Moreover, since the bypass-cutting valves are automatically switched on the basis of the signals output from the controlling means, the central bypass lines are appropriately and reliably opened or closed without switching errors.

It is preferable that the control device further includes a switching valve for switching flow channels, the switching valve controlling the oil supply to the groups. Moreover, it is preferable that the hydraulic actuators for motors that drive left and right crawlers belong to separate groups, and the switching valve be switched to a simultaneous-operation position where oil discharged from the common hydraulic pumps is supplied to the groups when the control valve for one of the driving motors and the control valve for one of the other hydraulic actuators included in the same group are operated at the same time.

It is preferable that the bypass-cutting valves be integrated into a common valve that opens or closes the central bypass lines of corresponding groups at the same time.

With this structure, one bypass-cutting valve can suffice for the plurality of groups. This leads to a simplified circuit structure, and is advantageous costwise.

It is preferable that the bypass-cutting valves be switched on the basis of signals common with those input to the unified bleed-off valves, and are opened when the unified bleed-off valves are not operated.

With this structure, the bypass-cutting valves are drivingly connected to the unified bleed-off valve. Therefore, the oil discharged from the pumps can be reliably unloaded when the unified bleed-off valves are not operated.

It is preferable that the bypass-cutting valves are integrated into the control valves disposed at the most downstream parts of the corresponding groups as sub-spools.

This leads to space-saving and a simplified pipeline structure.

DESCRIPTION OF THE PREFERRED EMBODIMENTS

Embodiments of the present invention will now be described with reference to FIGS. 1 to 5.

In the following embodiments, the present invention is applied to a hydraulic excavator.

Figure 1:
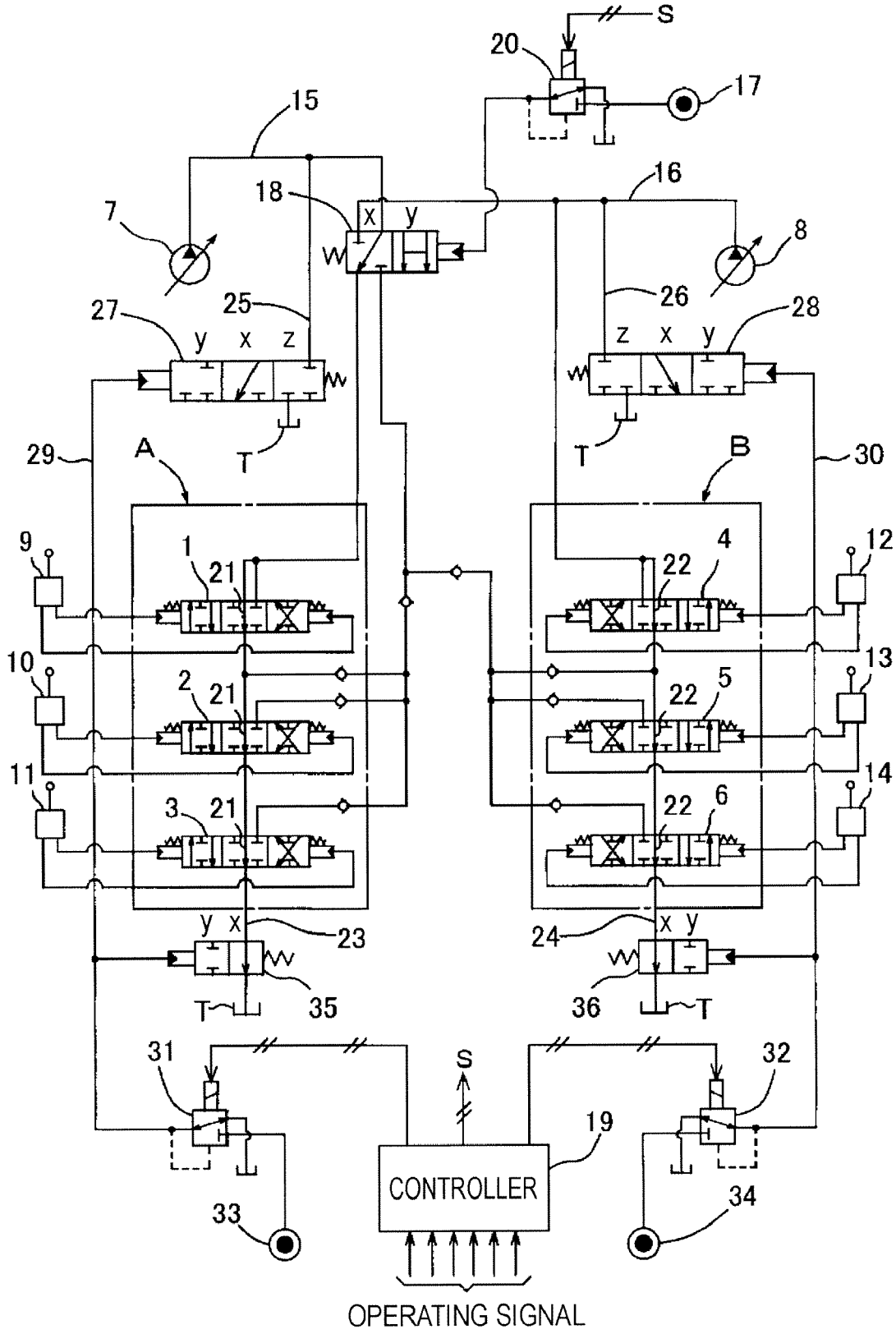
FIG. 1 illustrates the circuit structure according to a first embodiment of the present invention.
Figure 2:
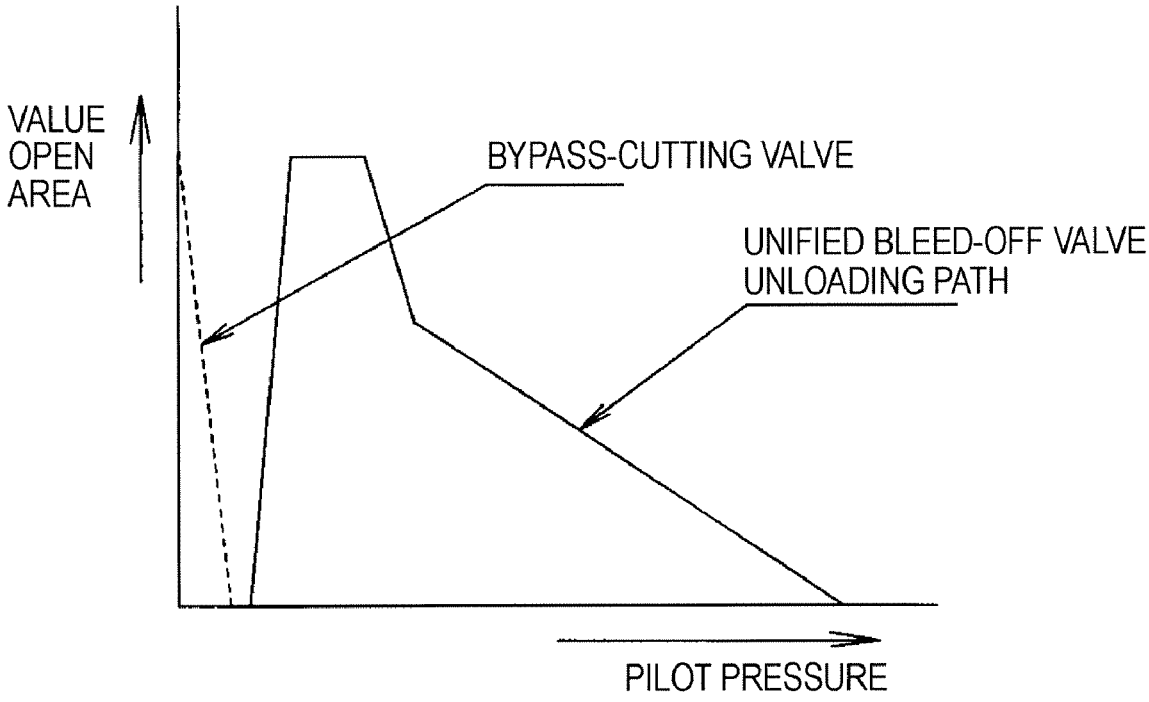
FIG. 2 illustrates opening characteristics of a unified bleed-off valve and a bypass-cutting valve according to the first embodiment.

First Embodiment (FIGS. 1 and 2)

In this embodiment, hydraulic actuators are grouped into a first group A including a right driving motor, a bucket cylinder, and boom cylinder (not shown), and control valves 1, 2, and 3 of the hydraulic pilot type for controlling the actuation of the above-described components individually; and a second group B including a left driving motor, a rotating motor, and an arm cylinder (not shown), and control valves 4, 5, and 6 of the hydraulic pilot type for controlling the actuation of the above-described components individually. Basically, the actuators in the first group A are driven by a first hydraulic pump 7, and the actuators in the second group B are driven by a second hydraulic pump 8. Remote-control valves 9 to 14 are operating means for operating the control valves 1 to 6, respectively.

A switching valve 18 that switches flow channels is disposed on discharge lines 15 and 16 of the hydraulic pumps 7 and 8, respectively. The switching valve 18 is of the hydraulic pilot type, and is driven by a pilot-pressure source 17. This ensures the flow rate required for driving the hydraulic actuators when the two (or three) control valves for the hydraulic actuator for the traveling section and the other hydraulic actuator(s) included in the same group are operated at the same time (simultaneous operation).

The switching valve 18 is switched between a normal position x and a simultaneous-operation position y. At the normal position x, oil discharged from the first hydraulic pump 7 is supplied to the first group A including the right driving motor, and oil discharged from the second hydraulic pump 8 is supplied to the second group B including the left driving motor.

In contrast, during the above-described simultaneous operation, the switching valve 18 is switched from the normal position x to the simultaneous-operation position y by a pilot pressure supplied from a switching-control valve 20 of the proportional solenoid type to the switching valve 18 on the basis of signals S output from a controller 19 according to operating signals.

In this state, the oil discharged from both the hydraulic pumps 7 and 8 is merged, and distributed to both the groups A and B.

In the group A, the control valves 1 to 3 each have a central bypass path 21. In the group B, the control valves 4 to 6 each have a central bypass path 22. The central bypass paths 21 are connected in tandem so as to form a central bypass line 23. At this time, the control valve 1 for the driving motor is disposed at the most upstream part of the central bypass line 23. Similarly, the central bypass paths 22 are connected in tandem so as to form a central bypass line 24. At this time, the control valve 4 for the other driving motor is disposed at the most upstream part of the central bypass line 24.

In the first group A, the upstream portion of the central bypass line 23 is connected to the discharge line 15 of the first hydraulic pump 7 via the switching valve 18. In the second group B, the upstream portion of the central bypass line 24 is directly connected to the discharge line 16 of the second hydraulic pump 8. The downstream portions of the central bypass lines 23 and 24 are connected to tanks T.

On the other hand, unified bleed-off pipelines 25 and 26 extend from the discharge lines 15 and 16 of the hydraulic pumps 7 and 8, respectively, to corresponding tanks T, and unified bleed-off valves 27 and 28 of the hydraulic pilot type are disposed on the unified bleed-off pipelines 25 and 26, respectively, for performing bleed-off control of the groups in a collective manner in response to inputs to the remote-control valves.

The unified bleed-off valves 27 and 28 are switched between corresponding unloading positions x where the valve open areas are maximum and corresponding blocking positions y where the valve open areas are zero so as to perform the bleed-off control.

Moreover, the unified bleed-off valves 27 and 28 are also switched to corresponding fail-safe positions z serving as inactive (neutral) positions. At these fail-safe positions z, unloading paths are fully closed (neutral blocking state where the valve open areas are zero).

Proportional solenoid valves 31 and 32 controlled by the controller 19 are disposed on pilot lines 29 and 30 of the unified bleed-off valves 27 and 28, respectively. The downstream pressures of the proportional solenoid valves 31 and 32 are supplied to pilot ports of the unified bleed-off valves 27 and 28, respectively, as pilot pressures. Reference numbers 33 and 34 denote upstream-pressure sources of the proportional solenoid valves 31 and 32, respectively.

Bypass-cutting valves 35 and 36 of the hydraulic pilot type are disposed adjacent to the most downstream part of the central bypass lines 23 and 24, respectively. The downstream pressures of the proportional solenoid valves 31 and 32 are input to the bypass-cutting valves 35 and 36, respectively, as pilot pressures.

The bypass-cutting valves 35 and 36 are switched to corresponding unloading positions x when no pilot pressures are input, that is, when no downstream pressures are output from the proportional solenoid valves 31 and 32, respectively, or switched to corresponding blocking positions y when the pilot pressures are input.

When no downstream pressures are output from the proportional solenoid valves 31 and 32, the unified bleed-off valves 27 and 28 are switched to the corresponding fail-safe positions z, and the bypass-cutting valves 35 and 36 are switched to the corresponding unloading positions x such that the central bypass lines 23 and 24, respectively, are opened.

In a normal state, when the remote-control valves 9 to 14 are operated, the corresponding control valves are actuated, and the corresponding hydraulic actuators are operated. At the same time, signals are output from the controller 19 to the proportional solenoid valves 31 and 32 on the basis of the operating signals, and the unified bleed-off valves 27 and 28 are switched between the unloading positions x and the blocking positions y according to the downstream pressures of the proportional solenoid valves 31 and 32, respectively, so as to change the bleed-off rates.

Moreover, the downstream pressures of the proportional solenoid valves 31 and 32 are also sent to the bypass-cutting valves 35 and 36, respectively, and the bypass-cutting valves 35 and 36 are switched to the corresponding blocking positions y.

When the switching valve 18 is switched to the simultaneous-operation position y, oil discharged from the hydraulic pumps 7 and 8 is merged and distributed to both the groups A and B.

At this time, the bypass-cutting valves 35 and 36 are at the blocking positions y, and the central bypass lines 23 and 24 are closed. Therefore, for example, the oil discharged from the pumps is not unloaded from the central bypass line 23 of the first group A, and the actuators in the second group B can be operated.

On the other hand, when an unusual event such as a break in the wires of a control system connecting the controller 19 and the proportional solenoid valves 31 and 32 occurs and the proportional solenoid valves 31 and 32 malfunction, the unified bleed-off valves 27 and 28 are switched to the corresponding fail-safe positions z.

In this state, the unloading paths of the unified bleed-off valves 27 and 28 are fully closed. Thus, oil supply to both the groups A and B is maintained even during failure due to abnormalities.

In this case, the bleed-off operation in the groups A and B is performed through the central bypass paths 21 and 22 of the control valves 1 to 3 and the control valves 4 to 6, respectively.

That is, since the unified bleed-off valves 27 and 28 are closed (in the corresponding fail-safe positions z) when an abnormality occurs, the operation of the actuators is ensured, and at the same time, the bleed-off operation is also ensured by the control valves 1 to 6.

If the control valves 1 to 6 are configured to ensure necessary and sufficient bleed-off function, the length of the control valves 1 to 6 in a spool shaft direction needs to be increased. This goes against the original object of reducing the size of the control valves by means of the unified bleed-off valves 27 and 28.

Therefore, the opening characteristics of the control valves 1 to 6 and the unified bleed-off valves 27 and 28 are set such that the central bypass paths 21 and 22 are closed immediately after the stroke operation of the spools of the control valves 1 to 6 is started, and that the bleed-off operation of the unified bleed-off valves 27 and 28 is started after the central bypass paths 21 and 22 are closed.

Moreover, the opening characteristics of the bypass-cutting valves 35 and 36 are set so as to be closed in the initial stage of the stroke operation of the spools of the control valves 1 to 6 in accordance with the closing of the central bypass paths 21 and 22.

FIG. 2 illustrates the opening characteristics of the unified bleed-off valves 27 and 28 and the bypass-cutting valves 35 and 36. In FIG. 2, the abscissa represents the pilot pressure generated by operating the remote-control valves, i.e., the spool stroke of the control valves 1 to 6.

Figure 3:
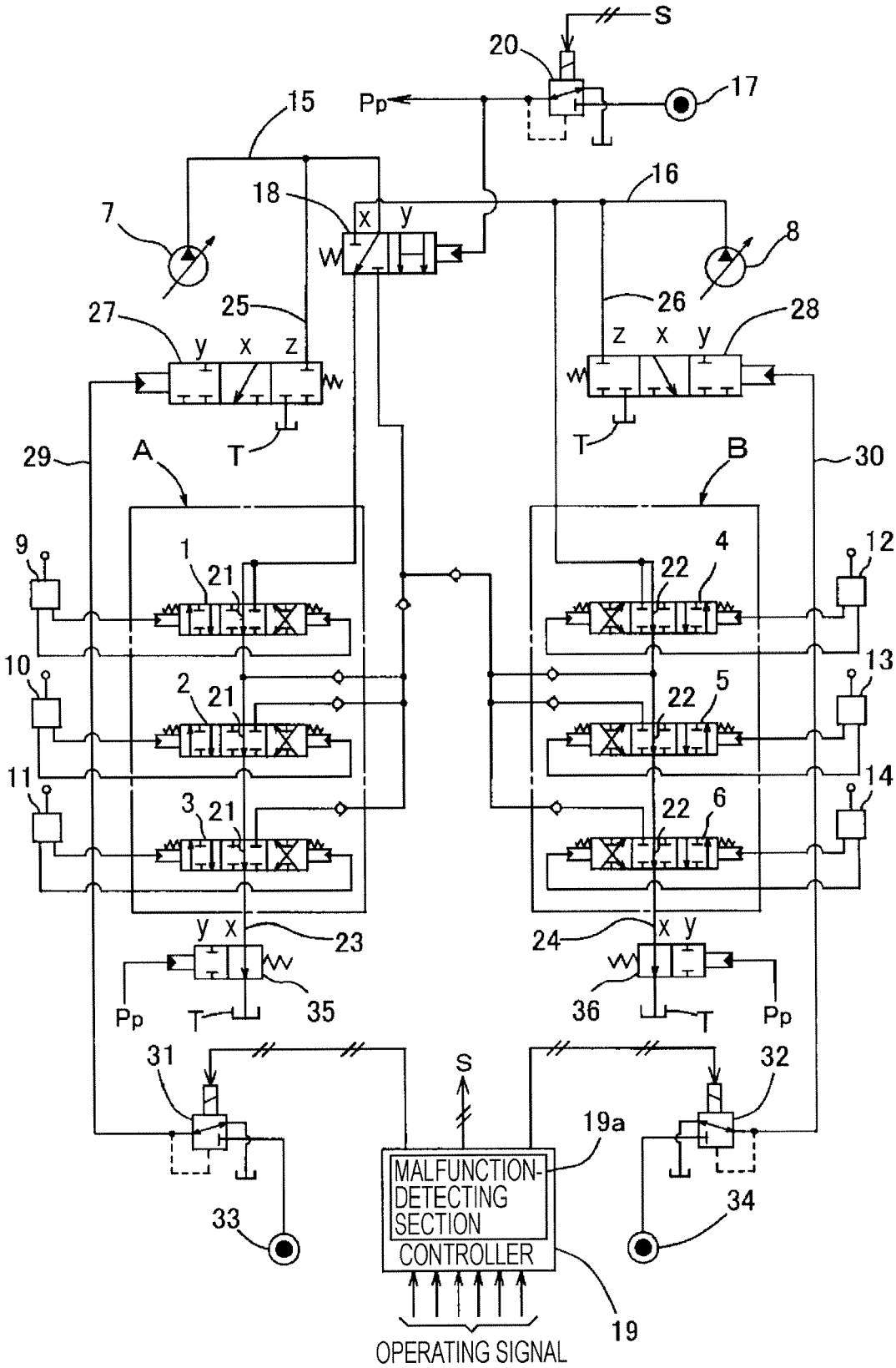
FIG. 3 illustrates the circuit structure according to a second embodiment of the present invention.

Second Embodiment (FIG. 3)

In the following embodiment, only differences from the first embodiment will be described.

In the first embodiment, the downstream pressures of the proportional solenoid valves 31 and 32 that control the unified bleed-off valves 27 and 28, respectively, are directly input to the bypass-cutting valves 35 and 36 as pilot pressures. In contrast, in a second embodiment, a downstream pressure Pp of the switching-control valve 20 that controls the switching valve 18 is input to the bypass-cutting valves 35 and 36 as a pilot pressure.

In this case, the controller 19 has a malfunction-detecting section **19*a* that detects abnormal conditions such as breaks in the wires in an output-signal system of the proportional solenoid valves 31 and 32 on the basis of reductions or the like in voltages or currents. When an abnormal condition is detected, the controller 19 stops outputting the signals to the switching-control valve 20, and the downstream pressure Pp of the switching-control valve 20** is reduced (becomes zero).

With this structure, when the switching valve 18 is switched to the simultaneous-operation position y, the bypass-cutting valves 35 and 36 are switched to the corresponding blocking positions y, and the central bypass lines 23 and 24 are closed. With this, the unloading operation is stopped while the oil discharged from both the hydraulic pumps 7 and 8 are distributed to both the groups A and B. Thus, the operation of the actuators can be ensured.

On the other hand, when the unified bleed-off valves 27 and 28 are switched to the fail-safe positions z due to an abnormality, the controller 19 stops outputting signals to the switching-control valve 20, and the downstream pressure Pp of the switching-control valve 20 is reduced as described above. With this, the bypass-cutting valves 35 and 36 operated by the downstream pressure Pp are switched to the corresponding unloading positions x, and the oil is unloaded through the central bypass lines 23 and 24.

Figure 4:
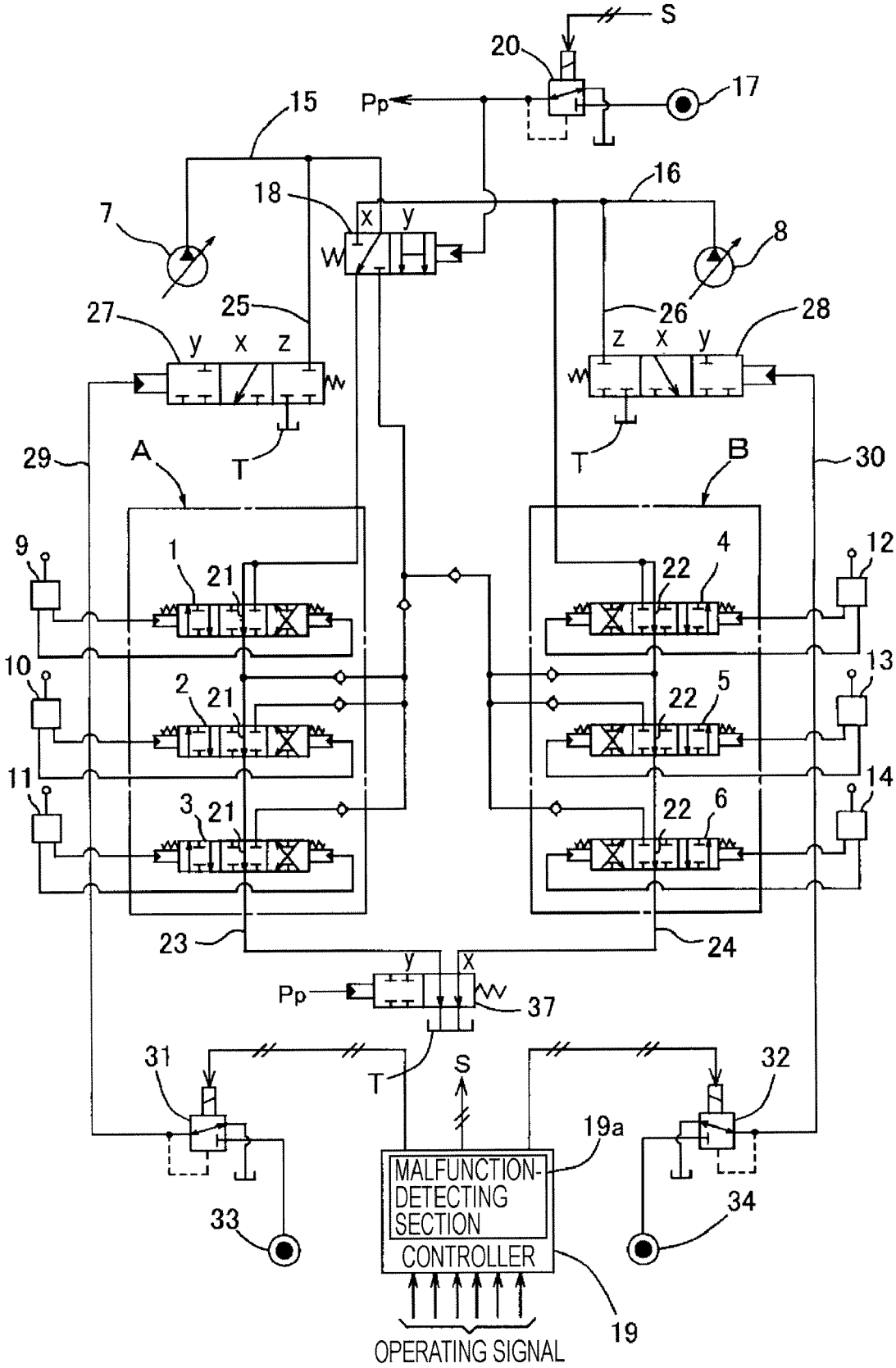
FIG. 4 illustrates the circuit structure according to a third embodiment of the present invention.

Third Embodiment (FIG. 4)

In a third embodiment, a common bypass-cutting valve 37 is disposed adjacent to the most downstream part of the central bypass lines 23 and 24. The bypass-cutting valve 37 opens or closes the central bypass lines 23 and 24 of the groups A and B, respectively, in a collective manner.

The bypass-cutting valve 37 is controlled using the downstream pressure Pp of the switching-control valve 20 as in the second embodiment, and is switched from a blocking position y to an unloading position x so as to unload oil when the unified bleed-off valves 27 and 28 are switched to the fail-safe positions z due to an abnormality.

With this structure, the two groups A and B share one bypass-cutting valve. This leads to a simplified circuit structure, and is advantageous costwise.

The downstream pressures of the proportional solenoid valves 31 and 32 can be used as a pilot pressure for controlling the bypass-cutting valve 37 as in the first embodiment.

Figure 5:
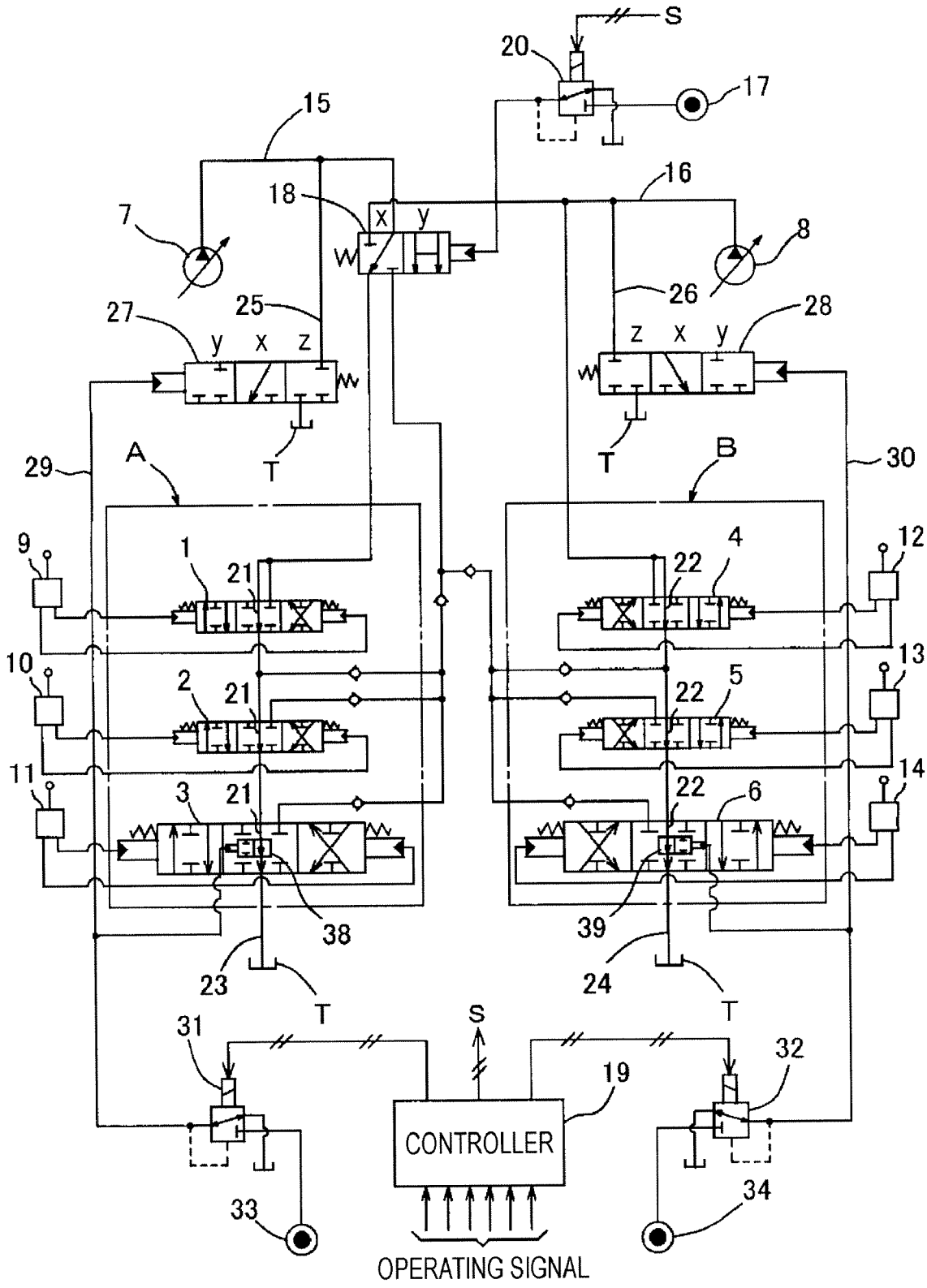
FIG. 5 illustrates the circuit structure according to a fourth embodiment of the present invention.

Fourth Embodiment (FIG. 5)

In a fourth embodiment, bypass-cutting valves 38 and 39 are integrated into the control valves 3 and 6 disposed at the most downstream parts of the groups A and B, respectively, as sub-spools. The bypass-cutting valves 38 and 39 are switched according to the downstream pressures of the proportional solenoid valves 31 and 32 serving as the pilot pressures.

With this structure, no independent bypass-cutting valves are required. This leads to space-saving and a simplified pipeline structure.

In the above-described embodiments, the unified bleed-off valves 27 and 28 are configured to block the oil discharged from the pumps when the valves are in a neutral state. However, the unified bleed-off valves 27 and 28 can be configured to open the unloading paths thereof when the valves are in a neutral state, and the unloading paths can be connected to the central bypass lines 23 and 24.

Although the invention has been described with reference to the preferred embodiments in the attached figures, it is noted that equivalents may be employed and substitutions made herein without departing from the scope of the invention as recited in the claims.

What is claimed is:

1. A hydraulic control device for a working machine comprising:

control valves switched by operating means;

hydraulic actuators separately controlled by corresponding control valves, the hydraulic actuators and the control valves being divided into two groups consisting of the first and the second groups, oil discharged from common hydraulic pumps being supplied to both of the two groups;

unified bleed-off valves separately performing unified bleed-off operation on all of the control valves belonging to each of the first and the second groups on the basis of signals output from controlling means according to inputs from the operating means;

central bypass paths provided in the control valves, the central bypass paths of the each group being connected in tandem so as to form a central bypass line for unloading operation; and bypass-cutting valves disposed adjacent to the most downstream part of the central bypass lines for opening or closing the central bypass lines, wherein the bypass-cutting valves are automatically switched on the basis of the signals output from the controlling means, and are adapted to open the central bypass lines when the unified bleed-off valves are not operated.

2. The hydraulic control device according to claim 1, further comprising:

a switching valve for switching flow channels, the switching valve controlling the oil supply to the groups, wherein the hydraulic actuators for motors that drive left and right crawlers belong to separate groups; and the switching valve is switched to a simultaneous-operation position where oil discharged from the common hydraulic pumps is supplied to the groups when the control valve for one of the driving motors and the control valve for one of the other hydraulic actuators included in the same group are operated at the same time.

3. The hydraulic control device according to claim 1, wherein the bypass-cutting valves are integrated into a common valve that opens or closes the central bypass lines of corresponding groups at the same time.

4. The hydraulic control device according to claim 3, wherein the bypass-cutting valves are switched on the basis of signals common with those input to the unified bleed-off valves, and are opened when the unified bleed-off valves are not operated.

5. The hydraulic control device according to claim 1, wherein the bypass-cutting valves are integrated into the control valves disposed at the most downstream parts of the corresponding groups as sub-spools.

6. A hydraulic control device for a working machine, comprising:

control valves switched by operating means;

hydraulic actuators separately controlled by corresponding control valves, the hydraulic actuators being divided into groups, oil discharged from common hydraulic pumps being supplied to the groups;

unified bleed-off valves separately performing unified bleed-off operation on the groups on the basis of signals output from controlling means according to inputs from the operating means, wherein the unified bleed-off valves are closed in the absence of one of said signals from the controlling means;

central bypass paths provided in the control valves, the central bypass paths of each group being connected in tandem so as to form a central bypass line for unloading operation; and bypass-cutting valves disposed adjacent to the most downstream part of the central bypass lines for opening or closing the central bypass lines, wherein the bypass-cutting valves are switched on the basis of the signals output from the controlling means and are positioned to open the central bypass lines in the absence of one of said signals from the controlling means, wherein the bypass-cutting valves are adapted to open the central bypass lines in the absence of said one of said signals from the controlling means when the unified bleed-off valves are not operated.

* * * * *